United States Patent [19]

Shemtov

[11] 4,191,312

[45] Mar. 4, 1980

[54] MULTICOMPARTMENT CONDIMENT AND SPICE DISPENSER

[76] Inventor: Sami Shemtov, 1228 E. 73rd St., Brooklyn, N.Y. 11228

[21] Appl. No.: 905,736

[22] Filed: May 15, 1978

[51] Int. Cl.[2] ..... A47G 19/12

[52] U.S. Cl. ..... 222/142.9

[58] Field of Search ..... 222/42, 44, 48, 142.1, 222/142.2, 142.6, 142.9

[56] References Cited

U.S. PATENT DOCUMENTS

| | | | |
|---|---|---|---|
| 2,526,308 | 10/1950 | Vorsanger | 222/142.9 |
| 2,655,288 | 10/1953 | Caretto | 222/142.9 X |
| 3,211,334 | 10/1965 | McShea | 222/44 X |
| 3,737,075 | 6/1973 | Atchley | 222/142.9 |

FOREIGN PATENT DOCUMENTS

| | | | |
|---|---|---|---|
| 2413900 | 9/1975 | Fed. Rep. of Germany | 222/142.9 |
| 326479 | 12/1957 | Switzerland | 222/142.9 |

*Primary Examiner*—Allen N. Knowles

*Attorney, Agent, or Firm*—Howard C. Miskin

[57] ABSTRACT

A condiment and spice dispenser includes a cylindrical body member having circumferentially spaced open topped vertical compartments and a central circular top wall with a coaxial threaded upwardly directed shank. A circular cover is rotatably releasably secured to the top of the body member by a thumb screw member engaging the threaded shank and having a stub shaft registering with a central opening in the cover. A section of the cover corresponding to a compartment top opening is perforate so that the cover may be turned to provide access to a selected compartment while covering the others and bosses and depressions are formed in the confronting borders of the cover and body members to releasably lock the cover in a selected position.

9 Claims, 4 Drawing Figures

MULTICOMPARTMENT CONDIMENT AND SPICE DISPENSER

BACKGROUND OF THE INVENTION

The present invention relates generally to improvements in receptacles for dispensing particulate materials and it relates more particularly to an improved receptacle for containing and selectively dispensing a plurality of particulate materials such as condiments, powdered spices and the like.

In the storing and table dispensing of salt, peppers, and other spices, vegetable powders such as onion and garlic powders and the like, it is a common practice to package each of these in individual containers which may be provided with cover members movable between open and closed positions and a multi-apertured member overlying or movable into registry with the container opening. While the conventional salt and pepper cellar and the conventional dispensing type containers for spices and vegetable powders are satisfactory for general kitchen use they possess numerous drawbacks and disadvantages when employed at the table. Since each condiment and spice requires a separate container, their use is awkward, inconvenient, expensive and space consuming, and otherwise leaves much to be desired.

SUMMARY OF THE INVENTION

It is an object of the present invention to provide an improved dispensing receptacle for particulate materials.

Another object of the present invention is to provide an improved receptacle for separately storing a plurality of different particulate materials and for selectively individually dispensing the particulate materials.

Still another object of the present invention is to provide an improved receptacle for separately storing and individually selectively dispensing a plurality of condiments, spices and the like in a powdered, granular or other particulate state.

A further object of the present invention is to provide an improved dispensing receptacle of the above nature characterized by its simplicity, ruggedness, ease of operation, low cost, convenience, attractive appearance, reliability and high versatility and adaptability.

The above and other objects of the present invention will become apparent from a reading of the following description taken in conjunction with the accompanying drawings which illustrate a preferred embodiment thereof.

In a sense, the present invention contemplates the provision of an improved receptacle device for storing and individually selectively dispensing a plurality of particulate materials comprising a body member formed with a plurality of circumferentially spaced vertical compartments provided with top openings, a cover member rotatably mounted atop the body member and including a perforate section having one or preferably a plurality of apertures and being of an area not greatly exceeding the transverse cross sectioned area of a compartment, the cover member being rotatable to transfer the perforate section into selective engagement with a respective compartment opening and locking means for releasably retaining cover at a selected angular position relative to the body member with the perforate section registering with a respective compartment opening.

In accordance with a preferred embodiment of the present invention the body member is integrally formed and is of cylindrical configuration of a transverse cross section which is preferably circular although the body member may be of other configuration and cross section, for example, polygonal. The body member includes coaxial inner and outer peripheral walls connected at their lower edges by a bottom wall and the top of the inner peripheral wall is closed by a top wall provided with an upwardly directed threaded shank. The space between the inner and outer walls is divided into similar compartments by regularly circumferentially spaced radial vertical partitions. The cover member is of the same outer parameter as the body member and is provided with a multi-apertured perforate section and includes a central opening surrounded by an upwardly directed coaxial collar and radial fins projecting outwardly from the collar. The cover member rests on the body member with the central opening coaxial with the threaded shank and a circular cylindrical nut having a top finger piece nests in the collar and has a depending coaxial stud engaging the cover member central opening and engages the threaded shank to releasably retain the cover member on the body member. A dimple is formed in the cover member underface and releasably engages a selected recess of a plurality of circumferentially spaced recesses formed in the top face of the body member outer wall to releasably lock the cover member against rotation with the perforate section coaxially registering with a selected compartment.

The improved device is simple, rugged, convenient, reliable, of low cost and attractive appearance, compact and easy to use and of great versatility and adaptability.

DESCRIPTION OF THE PREFERRED EMBODIMENT

Figure 1:
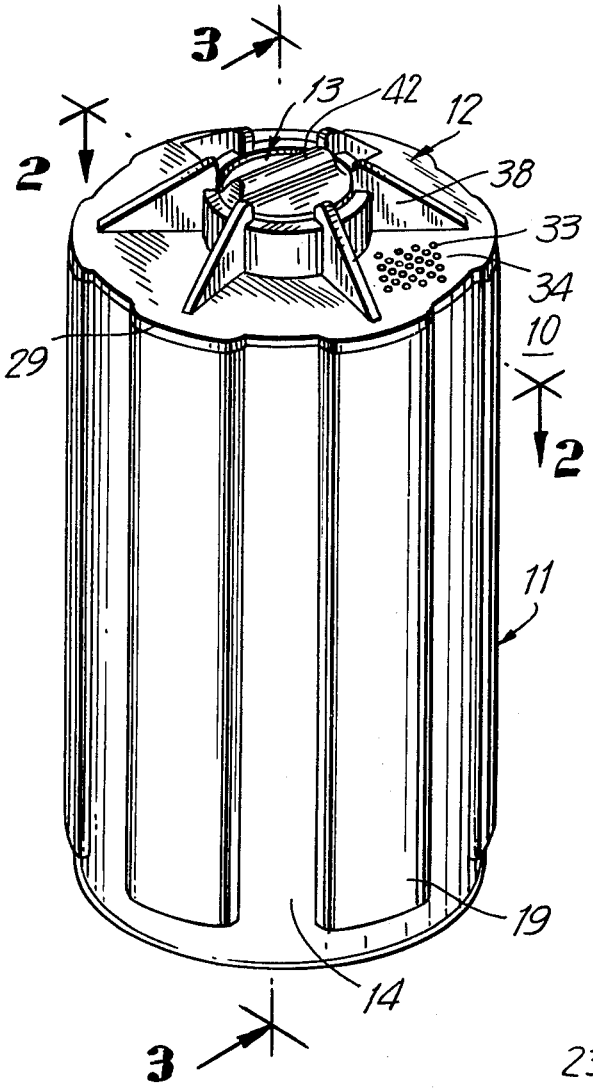
FIG. 1 is a front perspective view of a dispensing device embodying the present invention.
Figure 2:
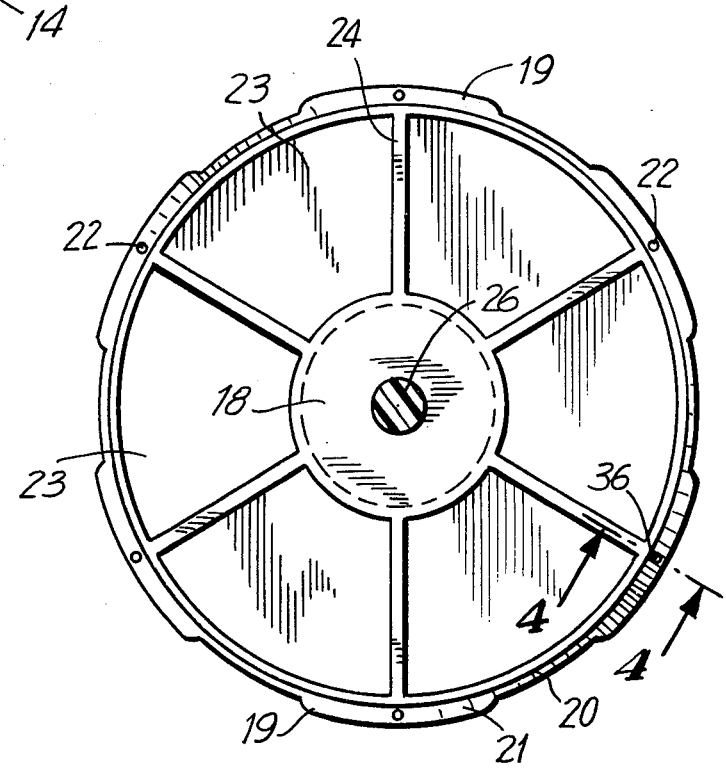
FIG. 2 is a sectional view taken along line 2—2 in FIG. 1.
Figure 3:
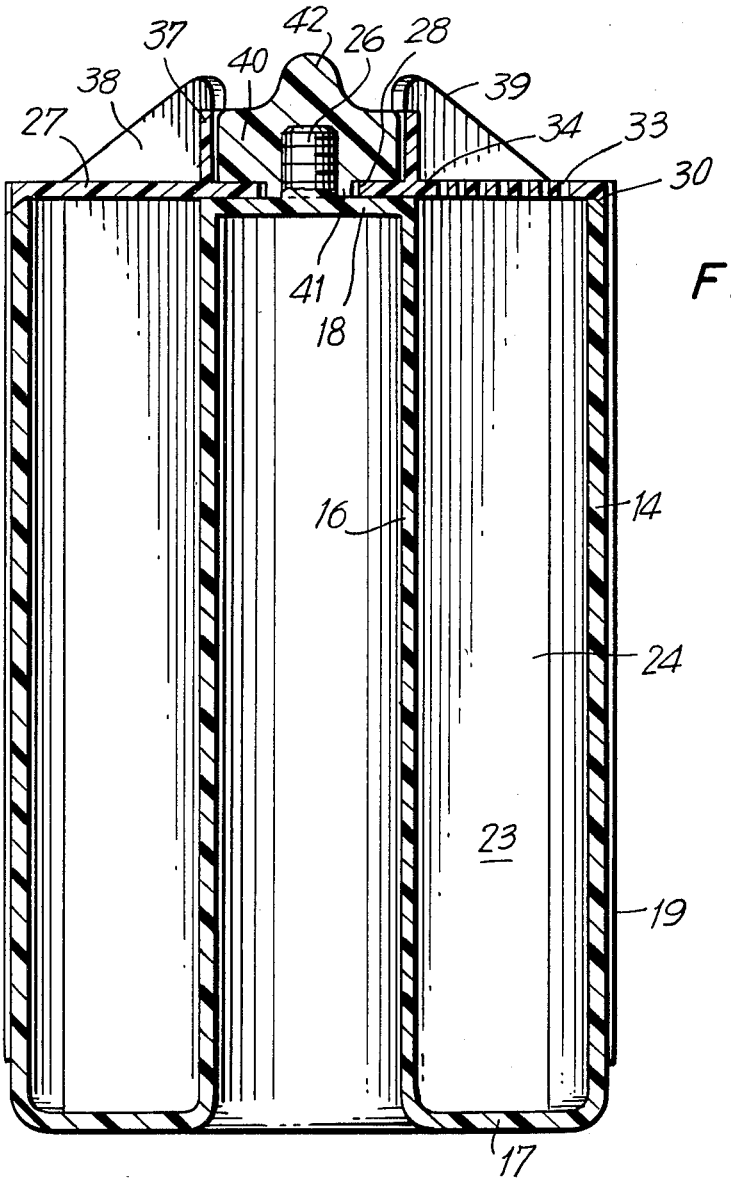
FIG. 3 is a sectional view taken along line 3—3 in FIG. 1.
Figure 4:
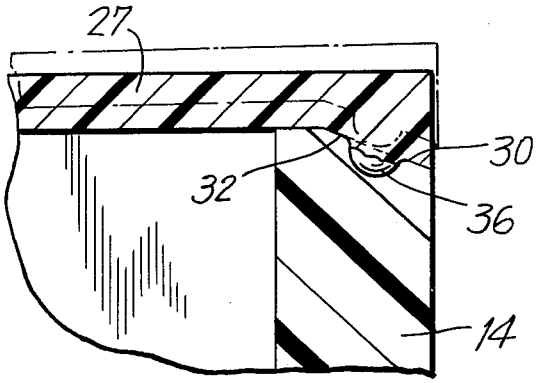
FIG. 4 is an enlarged sectional view taken along line 4—4 in FIG. 2.

Referring now to the drawings which illustrate a preferred embodiment of the present invention, the reference numeral 10 generally designates the improved dispensing device which includes a compartmented receptacle body member 11, a rotatable cover member 12 superimposed on the top face of the body member 11 and a retainer nut 12 for releasably retaining the cover member 12 rotatably assembled to the body member 11.

The body member 11 is advantageously an integral unit formed of a suitable thermoplastic, preferably transparent, synthetic organic polymeric resin, for example, a polyacrylic resin, polystyrene or the like, by infection molding, and while illustrated as being of circular cylindrical shape it may be of other desirable configuration, for example, of polygonal transverse cross section. The body member 11 includes a vertical outer cylindrical peripheral wall 14 and a coaxial inner cylindrical wall 16, the lower edges of cylindrical walls 14 and 16 being joined by an integrally formed annular bottom wall 17 and the top of the inner cylindrical wall being closed by an integrally formed circular top wall 18.

A plurality of regularly circumferentially spaced wide vertical ribs 19, illustrated as six in number, are formed on the outer face of outer cylindrical wall 14. The outer top peripheral edge 20 of outer wall 14 is bevelled as are the top faces 21 of ribs 19, the bevelled edges 20 and top faces 21 being coplanar and the ribs 19 terminating at their bottoms above the bottom of outer wall 14. Medially formed in the top face 21 of each rib 19 is a semipherical depression 22 having flared upper borders.

The annular space between the cylindrical outer and inner walls 14 and 16 is divided into a plurality of circumferentially spaced similar open topped vertical compartments 23 of truncated sector transverse cross section by vertical partitions or panels 24 extending radially between and integrally formed with the inner and outer walls 16 and 14 and bottom wall 17, and in radial alignment with respective depressions 22, the top edges of partitions 24 being coplanar with the top face of top wall 18 and the top inner edge of the outer wall top face. Integrally formed with top wall 18 and coaxial therewith is an upwardly directed externally threaded pin 26.

The cover member 12 is likewise advantageously formed as a unit of a thermoplastic synthetic organic polymeric resin and includes a substantially circular flat bottom section 27 with a parameter similar to that of the top face of body member outer wall 14. A circular opening 28 of greater diameter than that of pin 26 is centrally formed in cover member section 27, the cover member section 27 resting on the top wall 18 and top faces 20 and 21 with the opening 28 coaxial with the pin 26 and the cover section 27 is provided with peripherally spaced outwardly projecting portions 29 similar in shape to the transverse cross section of ribs 19. A peripheral lip 30 depends from the periphery of cover section 27 including portion 29 and has an outwardly downwardly inclined underfaced 32 which rests on and slidably engages the bevelled top faces 26 and 21.

A plurality of apertures 33 are formed in a perforate section 34 or cover section 27, the area of the perforate section 34 is of a shape and dimensions no greater than the cross section of a compartment 23. Medially formed in the underface of at least one of the cover member peripheral sections 29 is a projection or boss 36 of the configuration of a depression 22, the dimple 36 releasably engaging a selected depression 22 to position the perforate section 34 in coaxial registry with the open top of any selected compartment 23. Thus, the mating dimple 36 and depression 22 releasably retain the cover member 12 against rotation with the perforate section 34 in registry with a selected compartment 23.

An upstanding collar 37 of greater inside diameter than opening 28 is coaxially integrally formed with the cover section 27. A plurality of regularly circumferentially spaced vertical finger engageable fins 38, six in number, extend radially outwardly from the collar 37 and are integrally formed with the collar 37 and cover section 27. The fins 38 are medially disposed relative to the cover projecting sections 29 and have downwardly outwardly inclined top edges 39 which extend from points above the collar 37 to points at the level of and short of the periphery of cover section 27.

The retainer nut 13 includes a cylindrical body section 40 having a depending coaxial cylindrical stub 41 of a reduced diameter slightly less than that of opening 28. A tapped axial bore is formed in stub 41 and body section 40 and engages threaded pin 26 with the underface of pin 26 normally engaging top wall 18 and the cover section 27 bordering opening 28 being rotatably sandwiched between the confronting faces of top wall 18 and nut body section 40, the stub 41 engaging the opening 28. A diametrically extending finger piece defining cross rib 42 is integrally formed with the top face of nut section 40.

The operation of the improved dispenser receptacle 10 is clear from the above description. In use the cover member 12 is manually turned by means of handle defining fins 39 to bring the cover perforate section 34 into registry with a compartment 23 containing the desired condiment or spice, the cover member being releasably retained in the selected position by interengagement between the dimple 36 and a depression 22. The particulate material in the selected compartment 23 is dispensed through the apertures 33 and if the material in another compartment is desired, the cover member is accordingly turned. When the material in one or more compartments is depleted, the cover may be removed by turning, loosening and separating the retainer nut 13 and replenishing the depleted compartments and thereafter reapplying the cover member and retainer nut. In order to identify the contents of the various compartments 23 the body member 11 may carry suitable identifying indicia or the contents may be viewed through the transparent wall 14.

While there has been described and illustrated a preferred embodiment of the present invention, it is apparent that numerous alterations, additions and omissions may be made without departing from the spirit thereof.

What is claimed is:

1. A device selectively dispensing a plurality of particulate materials comprising an integrally formed body member including outer and inner coaxial cylindrical walls and an annular bottom wall extending between the bottom edges of said cylindrical walls and a circular top wall located atop said inner cylindrical wall and regularly circumferentially spaced radial partitions extending between said cylindrical walls and delineating with said cylindrical walls a plurality of circumferentially spaced vertical compartments provided with top openings, a vertical pin coaxially upwardly projecting from said top wall, a cover member rotatably mounted in said body member and having a central opening coaxially registering with said pin and including a perforate section of an area not exceeding the transverse cross sectional area of one of said compartments at the top thereof, said cover member being rotatable to transfer said perforate section into selective registration with respective compartment top openings and first locking means releasably locking said cover member to said body member for rotation relative thereto.

2. The dispensing device of claim 1 including second locking means for releasably locking said cover to said body member against rotating at preselected positions with said perforate section registering with respective compartment openings.

3. The dispensing device of claim 2 wherein said body member has a plurality of circumferentially spaced recesses formed therein and said second locking means concludes a projection formed on the underface of said cover and movable into selective releasable engagement with said recesses with the rotation of said cover.

4. The dispensing device of claim 1 wherein said body member is of circular tranverse cross section, said compartments are of sector shaped transverse cross section and are open at their tops and said cover is circular and coaxial with said body member.

5. The dispensing device of claim 1 wherein said pin is threaded and said first locking means comprises a nut member having a threaded bore releasably engaging said threaded pin and overlying the border of said opening in said cover.

6. The dispensing device of claim 5 wherein said nut member is of cylindrical configuration and includes a depending coaxial stub of lesser transverse circular cross section registering with said opening in said cover member.

7. The dispensing device of claim 6 including a coaxial upwardly directed collar integrally formed with said cover member and surrounding said nut member, said nut member including an upwardly directed finger piece.

8. The dispensing device of claim 7 including a plurality of circumferentially spaced fins extending radially outwardly from said collar and integrally formed with said collar and cover member.

9. The dispensing device of claim 1 wherein said perforate section has a plurality of apertures formed therein.

* * * * *